US006068271A

United States Patent [19]

Lustica

[11] Patent Number: 6,068,271

[45] **Date of Patent: *May 30, 2000**

[54] INTEGRATED GOLF BAG AND CART

[76] Inventor: William Joseph Lustica, 211 W. 6th Ave., Baltimore, Md. 21225

[ * ] Notice: This patent issued on a continued prosecution application filed under 37 CFR 1.53(d), and is subject to the twenty year patent term provisions of 35 U.S.C. 154(a)(2).

[21] Appl. No.: 08/688,029

[22] Filed: Jul. 29, 1996

[51] Int. Cl.[7] ..... B62B 1/12

[52] U.S. Cl. ..... 280/47.26; 280/47.315; 280/DIG. 6

[58] Field of Search ..... 280/47.17, 47.19, 280/47.24, 47.26, 47.315, 47.33, DIG. 6; 403/408.1

[56] References Cited

U.S. PATENT DOCUMENTS

| | | | |
|---|---|---|---|
| 2,572,486 | 10/1951 | Isaac | 280/47.26 |
| 2,783,054 | 10/1957 | Stratton, Jr. | 280/47.19 |
| 2,911,228 | 11/1959 | Green | 280/DIG. 6 |
| 2,918,297 | 12/1959 | Peters | 280/DIG. 6 |
| 3,183,586 | 5/1965 | Sellers | 403/408.1 |
| 3,334,910 | 8/1967 | Wilson et al. | 280/DIG. 6 |
| 4,053,169 | 10/1977 | Taylor | 280/37 |
| 4,620,682 | 11/1986 | Yim | 280/DIG. 6 |
| 4,629,202 | 12/1986 | Nelson et al. | 280/47.26 |
| 4,726,597 | 2/1988 | Hickin | 280/47.17 |
| 4,822,071 | 4/1989 | Widegren | 280/646 |
| 4,852,896 | 8/1989 | Mills | 280/DIG. 6 |
| 5,071,147 | 12/1991 | Stansbury | 280/47.19 |
| 5,074,576 | 12/1991 | Finlay | 280/645 |
| 5,112,068 | 5/1992 | Liao et al. | 280/30 |
| 5,168,992 | 12/1992 | Bowdy | 280/DIG. 6 |
| 5,180,179 | 1/1993 | Salvucci | 280/47.315 |
| 5,415,284 | 5/1995 | King | 280/DIG. 6 |
| 5,435,581 | 7/1995 | Rosenfield | 280/30 |
| 5,599,037 | 2/1997 | Spickler | 280/47.26 |
| 5,671,842 | 9/1997 | Jaworski | 280/DIG. 6 |

FOREIGN PATENT DOCUMENTS

| | | | |
|---|---|---|---|
| 207045 | 3/1957 | Australia | 280/DIG. 6 |
| 686366 | 1/1953 | United Kingdom | 280/DIG. 6 |
| 932862 | 7/1963 | United Kingdom | 280/DIG. 6 |

*Primary Examiner*—J. J. Swann
*Assistant Examiner*—Frank Vanaman
*Attorney, Agent, or Firm*—Venable; George H. Spencer; Catherine A. Ferguson

[57] ABSTRACT

In a golf bag of the type having a generally tubular body, open at one end and including a rigid base portion enclosing the other end, an improved device is provided which includes a bore extending transversely through the rigid base portion, a divider portion adapted to substantially close the open end and including a plurality of holes which are adapted to receive for storage therein a shaft portion of a golf club, an axle adapted for insertion through the bore, a pair of wheels, each of which is removably attached to the axle on opposite ends of the bore, and a handle portion removably attached to the golf bag, proximate to the divider portion, for pulling the wheeled golf bag along the ground.

7 Claims, 4 Drawing Sheets

INTEGRATED GOLF BAG AND CART

BACKGROUND OF THE INVENTION

1. Field of the Invention

The present invention relates generally to apparatus for storing and transporting a plurality of golf clubs, and more particularly to improved apparatus which integrates an easily attachable yet quickly removable means for transporting a golf bag with clubs stowed therein during play.

2. Statement of the Prior Art

Various approaches to the combination of a golf bag and cart have been used in the past. For example, U.S. Pat. No. 5,435,581 (Rosenfield) discloses a kit to convert a conventional golf bag to a golf cart, in which an elastic band is attached to the base of the golf bag to receive a pair of wheels to add mobility to the bag when it is pulled by its attached strap. The kit further includes a stabilizing foot which is mounted on the elastic band on the side opposite the attached strap. Such an arrangement, while capable of providing a kit to adapt conventional golf bags, is nevertheless inherently unstable by virtue of its relatively loose connection to such golf bags through the elastic band. Its use of a short "stabilizing foot" which is displaced only a small distance from the center of rotation of the kit's wheels also does not provide sufficient stability. Moreover, when the converted golf bag is thus used in its cart mode, reliance upon the bag's attached strap as a means of pulling the cart would cause further instability underway.

Like the Rosenfield '581 patent, U.S. Pat. No. 5,112,068 (Liao et al.) discloses a convertible golf cart and bag having a pulling ring with a flexible strap which, when the golf bag is converted into a golf cart, is used to pull the golf bag. The bag has, at its base, a rigidly constructed T-shaped element to which removable spoked wheels and a support stand may be attached. While it provides a somewhat more stable platform that the Rosenfield '581 patent, the Liao et al. '068 patent also lacks certain stability underway by virtue of its use of the small, flexible strap.

U.S. Pat. No. 5,074,576 (Finlay) discloses another combination golf club container and cart which avoids the potential instability caused by use of a strap to pull the carts (as in the Rosenfield '581 and Liao et al. '068 patents) by using a rigid pivotal handle. Such handle may be folded back against the bag when not in use, and pivoted or extended when utilizing the device as a pull-cart. The device also includes a mechanically-complex, foldable strut assembly which is carried by a frame, and adapted to be folded flat against the frame or extended in a cantilever fashion to carry a wheel and axle assembly.

U.S. Pat. No. 4,822,071 (Widegren) discloses a golf bag unit having extendible and retractable traveling wheels and a ground support foot. It, like the Finlay '576 patent, includes a rigid pulling handle which is adapted to fold out of the way when not in use, and is mechanically complex.

U.S. Pat. No. 4,726,597 (Hickin) discloses a combination golf cart and golf bag assembly formed having a rigid tubular housing defining a capsule with a removable cover, the housing being provided with both upper and lower closed ends, wherein a plurality of elongated tubes are mounted in the upper end for receiving the shafts of golf clubs, a cup member being centrally positioned in the upper closed end for storing equipment, and the capsule being mountable to the outside structure of a vehicle by means of a first and a second structure bracket, there being wheels mounted to the lower end of the capsule and a removable handle mounted at the upper end of the capsule to define a cart in conjunction with the golf bag. The assembly according to the Hickin '597 patent, however, is exceptionally bulky and incapable of being stored/transferred in the trunks of most modern cars.

U.S. Pat. No. 4,629,202 (Nelson et al.) discloses a combination golf cart and bag provided with wheels and wheel struts that easily fit into place without complicated mechanical devices, and a handle which similarly fits into place and when all is not used are stored in similar fashion as the clubs. A support strut which is required on other prior art to stand free is ostensibly not necessary with this cart. However, the removable wheels, wheel struts, and handle are not positively locked in place when in use. As a result, there is an increased potential for the cart to come undone while being pulled over uneven terrain of the sorts found at most golf courses.

U.S. Pat. No. 4,053,169 (Taylor) discloses a combined golf bag and cart mechanism in which the bag and cart are permanently coupled to one another. The bag provides a rigid support for the cart and is provided with a cavity. The cart is movable between a retracted position in which the cart wholly nests within the cavity, and an extended position in which the cart supports the bag for transport. The cart has a pair of substantially elliptically shaped wheels, and an orienting device for maintaining the wheels in planes parallel to the axis of the cavity in both the retracted and extended positions of the cart. Nevertheless, the highly complex mechanical interactions required to deploy the cart make such cart difficult to use and susceptible to breakdown.

SUMMARY OF THE INVENTION

Accordingly, it is a general object of the present invention to provide apparatus for storing and transporting a plurality of golf clubs.

A more particular object of the present invention is to provide improved apparatus which integrates an easily attachable yet quickly removable means for transporting a golf bag with clubs stowed therein during play.

It is also an object of the present invention to provide such apparatus which is lightweight, mechanically simple, yet rugged, and capable of being carried in the trunks of most modern cars.

These and other objects, advantages, and novel features according to the present invention are provided by a golf bag, comprising a generally tubular body, open at one end and including a rigid base portion enclosing the other end. The rigid base portion has a bore extending transversely therethrough. A divider portion substantially encloses the open end of the golf bag and includes a plurality of holes, each of which is adapted to receive for storage therein a shaft portion of a golf club. An axle is adapted for insertion through the bore, and a pair of wheels, each of which is removably attached to that axle on opposite ends of the bore, are removably attachable thereto. A handle portion is also removably attached to the golf bag, proximate to the divider portion, for pulling the wheeled golf bag along the ground.

In accordance with one important aspect of the present invention, the divider portion further comprises resilient means for protecting the shaft portions of each golf club received within respective ones of the plurality of holes. Such resilient means may suitably comprise felt covering the entire periphery of each hole. Otherwise, the resilient means may comprise any composition which would be capable of preventing scratches, nicks, etc. on club shafts made from graphite, fiberglass reinforced plastic, coated metals, and the like.

The golf bag according to a presently preferred embodiment of this invention further comprises means within the divider portion for coupling the handle portion to the golf bag. Such coupling means may suitably comprise a telescoping joint which is formed by extension of the handle portion from a first, stowed position to a second, deployed position in which a distal end of the handle portion includes twist-lock means for locking the handle portion in its deployed position. Exemplary of such twist-lock means are the well-known telescoping joints used in frames of umbrella tents.

In the alternative, the coupling means may comprise a joint defined by the coupling of a female member formed in the divider portion and adapted to receive a male member formed on the handle portion. Such a joint could suitably comprise an internal threaded portion forming the female member and an external threaded portion forming the male member. Alternatively, the joint could suitably comprise a snap-fit joint between the female member and the male member.

Another suitable joint according to the present invention could further comprise a first hole bored transversely through the divider portion, and a second hole bored transversely through the handle portion. The second hole would be substantially the same size as the first hole and oriented such that the first hole and second hole are substantially coaxially aligned when the male member is inserted within the female member. In joints of this type, means for maintaining the first hole and second hole in coaxial alignment when the male member is inserted within the female member would be provided. Such means for maintaining could suitably comprises a simple pin, or more complex, lockable pins such as a toggle pin or a spring-loaded Dover pin.

According to yet another important aspect of the present invention, the integrated golf bag and cart can be provided in the form of a kit to adapt conventional, lightweight golf bags (e.g., those which may be referred to as "mountain bags") or functionally incorporated into an improved golf bag. In such cases, the golf bag would be of the type comprising a generally tubular body, open at one end and including a rigid base portion enclosing the other end. The improvement would comprise a bore extending transversely through that rigid base portion, a divider portion adapted to substantially close the open end and including a plurality of holes which are adapted to receive for storage therein a shaft portion of a golf club, an axle adapted for insertion through the bore, a pair of wheels, each of which is removably attached to the axle on opposite ends of the bore, and a handle portion removably attached to the golf bag, proximate to the divider portion, for pulling the wheeled golf bag along the ground.

These and other aspects of the integrated golf bag and cart according to the present invention will become more apparent from the following detailed description of a preferred embodiment thereof, when considered in conjunction with the accompanying drawings wherein:

BRIEF DESCRIPTION OF THE DRAWINGS

FIG. 5A shows means for holding holes in coaxial alignment thereby locking the handle portion.

DETAILED DESCRIPTION OF THE PREFERRED EMBODIMENT

Figure 1:
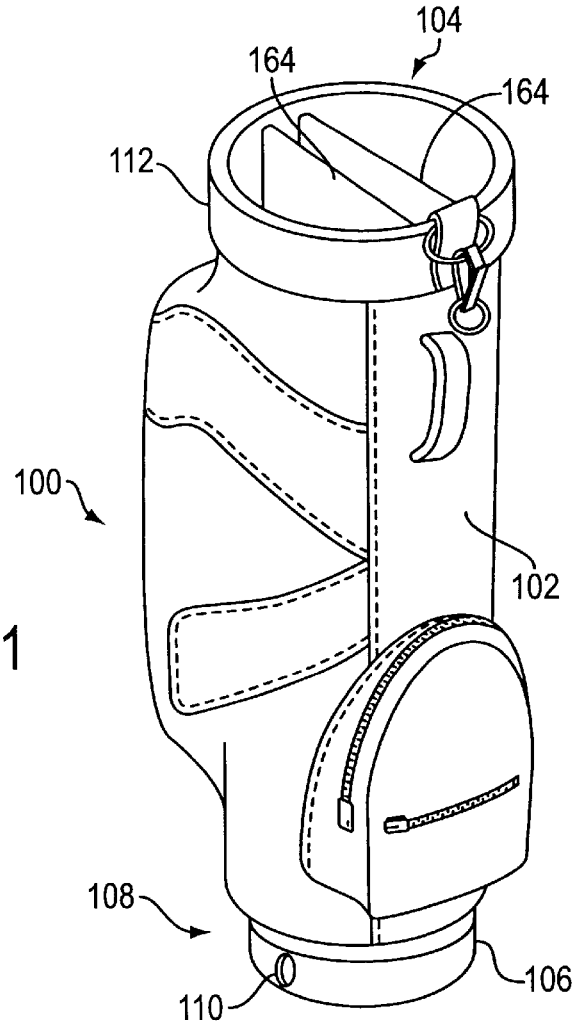
FIG. 1 shows an orthogonal view of a golf bag used in accordance with the present invention.

Referring now to the drawings, wherein like characters designate like or corresponding parts throughout the several views, there is shown in FIG. 1 a golf bag 100 used in accordance with the present invention. Golf bag 100 generally comprises a tubular body 102, open at one end 104 and including a rigid base portion 106 enclosing the other end 108. The rigid base portion 106, as is shown more clearly in FIGS. 2 and 3, has a bore 110 extending transversely therethrough. A divider portion 112 of the golf bag 100 is positioned at the open end 104.

Figure 4:
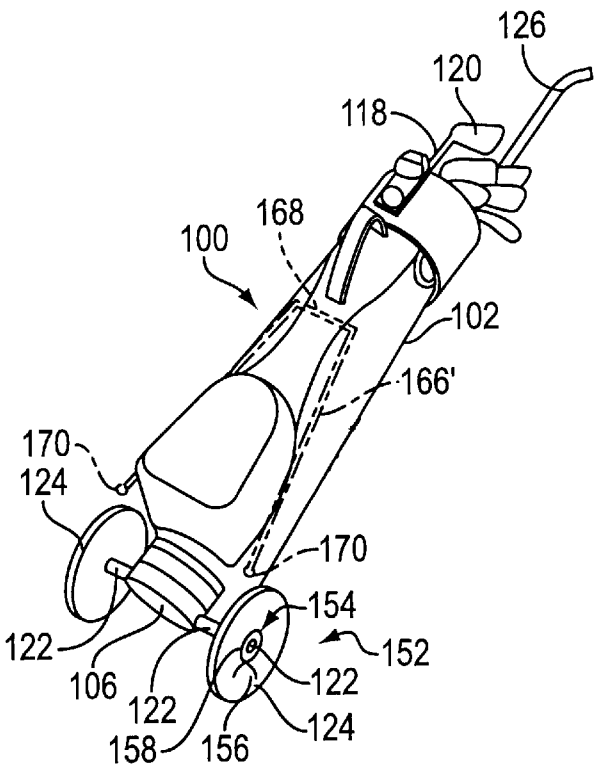
FIG. 4 is a perspective view of the golf bag according to FIGS. 1–3 with the fully deployed, integrated cart according to the present invention.

In accordance with one important aspect of the present invention, divider portion 112 further comprises an adaptive insert 114 as shown in FIGS. 5A, 5B and 6–8. Adaptive insert 114 substantially encloses the open end 104 and includes a plurality of holes 116, each of which is adapted to receive for storage therein a shaft portion 118 of a golf club 120 (FIG. 4). In such a manner, adaptive insert 114 facilitates ready conversion of a conventional golf bag 100 by way of an easily stowable kit. An axle 122 is adapted for insertion through the bore 110, and a pair of wheels 124, each of which is removably attached to the axle 122 on opposite ends of the bore 110. A handle portion 126 is removably attached to the golf bag 100, proximate to the divider portion 112, for pulling the wheeled golf bag 100 along the ground.

The golf bag 100, according to another important aspect of the present invention, is further improved by modification of divider portion 112 to include resilient means 128 for protecting the shaft portions 118 of each golf club 120 received within respective ones of the plurality of holes 116. This feature is especially important with usage of today's expensive golf clubs 120 which may have graphite, fiberglass reinforced plastic, or polished metal shaft portions 118. Accordingly, the resilient means may suitably comprise a layer of felt (or other similar such shock-absorbing and scratch-preventing materials) covering the entire periphery of each hole 116.

With reference now more specifically to FIGS. 3–4, 5A and 5B and 7, it may be shown that the divider portion 112 and adaptive insert 114 according to the present invention further comprises means 130 for coupling the handle portion 126 to the golf bag 100. Such coupling means 130 may suitably comprise any number of known methods and apparatus for securely coupling a generally tubular-shaped object such as the handle portion 126 to another object. For example, in accordance with one presently preferred embodiment of the invention disclosed herein, the coupling means 130 comprises a telescoping joint 132 which is formed by extension of the handle portion 126 from a first, stowed position (as shown by the letter "S" in FIG. 3) to a second, deployed position (as shown by the letter "D" in FIG. 3) in which a distal end 134 of the handle portion 126 includes twist-lock means 136 for locking the handle portion 126 in its deployed position D.

Such twist-lock means 136 are well known to those of ordinary skill in the art of designing camping equipment such as umbrella tents, which utilize metallic or plastic tubular frames to form an exoskeletal support structure for such tents. As is conventional in the use of such tents, the frames are comprised of a number of pairs of tubes, each of which consists of a first, outer tube and a second, inner tube which is adapted to fit slidingly within the outer tube. Each pair is stowed such that the inner tube is completely within the outer tube. Upon deployment for use in supporting the tent, the inner tube is extended in a telescope fashion outward from the outer tube until such point is reached that a twist-lock joint forming portion at a proximate end of the inner tube is in coaxial alignment with a similar twist-lock joint forming portion at the distal end of the outer tube. The outer tube is thereafter rotated about the inner tube in a clockwise fashion to lock them in place. A simple twist of the outer tube in a counter-clockwise fashion likewise would facilitate unlocking of the joint to permit the inner tube to be restowed completely within the outer tube in the manner shown at "S" in FIG. 3.

In general, the coupling means 130 comprises a joint defined by the adaptive insert 114 fitted into the coupling of a female member 138 formed in the divider portion 112. Such female member 138 is adapted to receive a male member 140 formed on the handle portion 126. As one alternative to the telescoping joint 132 including twist-lock means 136 as described herein above, the joint formed by the female member 138 and male member 140 comprises an internal threaded portion 142 formed upon a portion of the female member 138 and an external threaded portion 144 formed upon a portion of the male member 140. In yet another alternative, the joint formed by the female member 138 and male member 140 comprises a snap-fit joint between such member 138, 140.

Figure 5A:
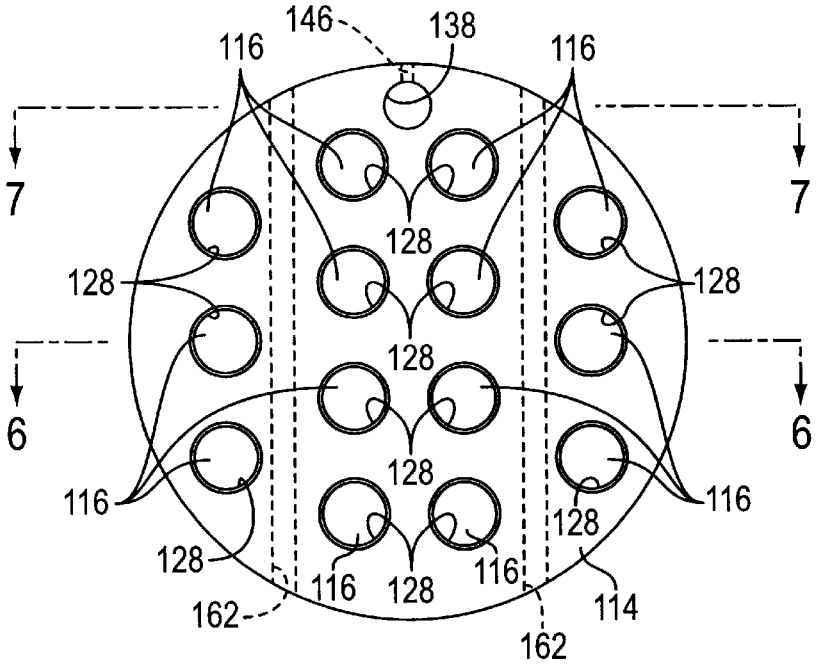
FIGS. 5A and 5B show a top view of the adaptive insert for a golf bag according to the present invention.
Figure 5B:
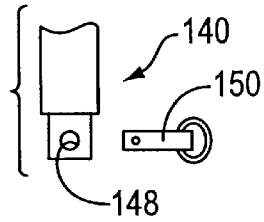
Figure 6:
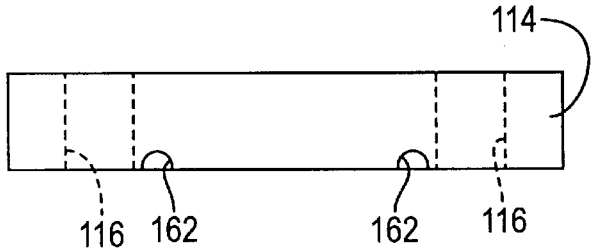
FIG. 6 is a sectional view of the adaptive insert shown in FIG. 5A, taken along the lines 6—6.
Figure 7:
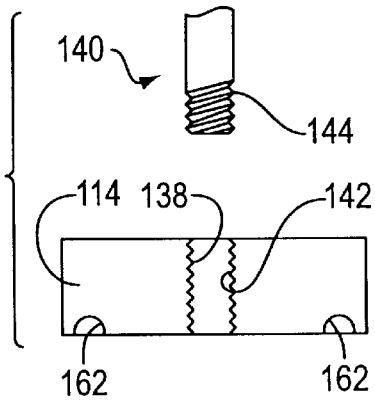
FIG. 7 is another sectional view of the adaptive insert shown in FIG. 5A, taken along the lines 7—7.

At least one other alternative means of coupling the female member 138 and male member 140 together would include a first hole 146 bored transversely through the divider portion 112 at the position of female member 138, and a second hole 148 bored transversely through the handle portion 126. Such second hole 148 would be substantially the same size as the first hole 146, and oriented such that the first hole 146 and second hole 148 are substantially coaxially aligned when said the male member 140 is inserted within the female member 138. In FIG. 5A means 150 are also provided for maintaining the first hole 146 and second hole 148 in coaxial alignment, and thereby locking the handle portion 126 in place when the male member 140 is inserted within female member 138. Suitable for use as maintaining means in accordance with this embodiment of the present invention would be toggle pins, spring-loaded pins known as "Dover" pins, lynch pins 150 and other similar such easily engaged, lockable pins.

In order to provide an integrated golf bag and cart which is lightweight, mechanically simple, yet rugged, and capable of being carried in the trunks of most modern cars, three other aspects of the present invention will now be disclosed. One particularly important aspect is the positioning of the bore 110 which extends transversely through base portion 106 of golf bag 100. It is necessary to offset the bore 110 slightly from the centerline of the base portion 106 in order to minimize the diameter of the wheels 124. Furthermore, it has been found that wheels 124 having a diameter of about seven inches provides sufficiently adequate stability, ground clearance, and ease of storage and installation for purposes of the present invention. Accordingly, since the diameters of most conventional golf bags 100 of the types used in the present invention are about nine inches, the bore 110 is preferably offset from the centerline of the base portion 106 by about two inches.

Figure 2:
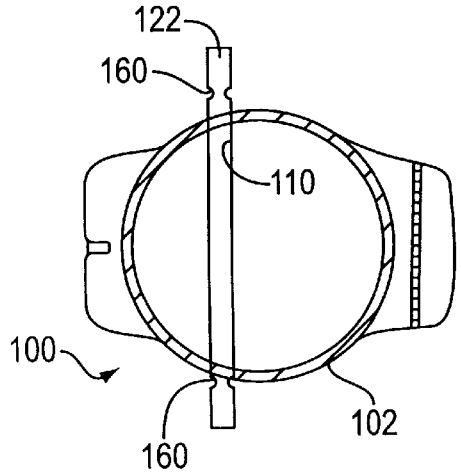
FIG. 2 is a bottom view of the golf bag shown in FIG. 1, illustrating the means for removably attaching a pair of wheels according to the present invention.
Figure 3:
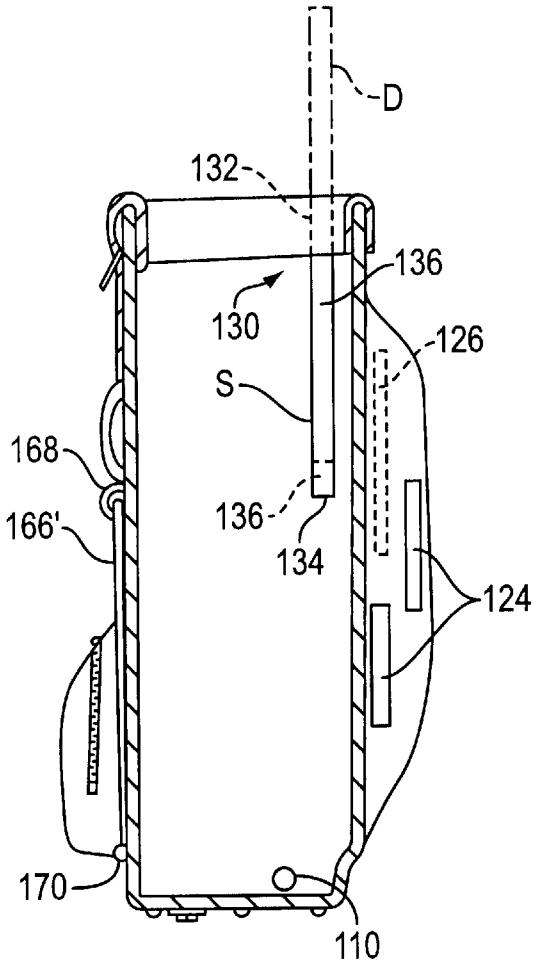
FIG. 3 is a cutaway view of the golf bag shown in FIGS. 1 and 2, illustrating the removable handle according to the present invention.

Another important aspect in providing an integrated golf bag and cart which is lightweight, mechanically simple, yet rugged, and capable of being carried in the trunks of most modern cars, is the means 152 for removably attaching a pair of wheels 124 according to the present invention shown in FIGS. 2–4. Such attaching means 152 can suitably comprise a pair of spring clamps 154, each of which includes a pair of arms 156 which may be pressed together to expand the annular surface 158 of a respective spring clamp 154 to slidably engage the axle 122. Upon release of the arms 156, the annular surface 158 contracts to lock in position about the axle 122. A washer (not shown) may be placed around the axle 122 on either side of the golf bag 100 inside a respective wheel 124, and the spring clamp 154 maintaining such wheel 124 in place. For an even more secure means 152 for removably attaching the wheels 124 according to the present invention, a channel 160 is preferably formed in the axle 122 to receive each spring clamp 154 and prevent it from slipping along the axle 122.

Figure 8:
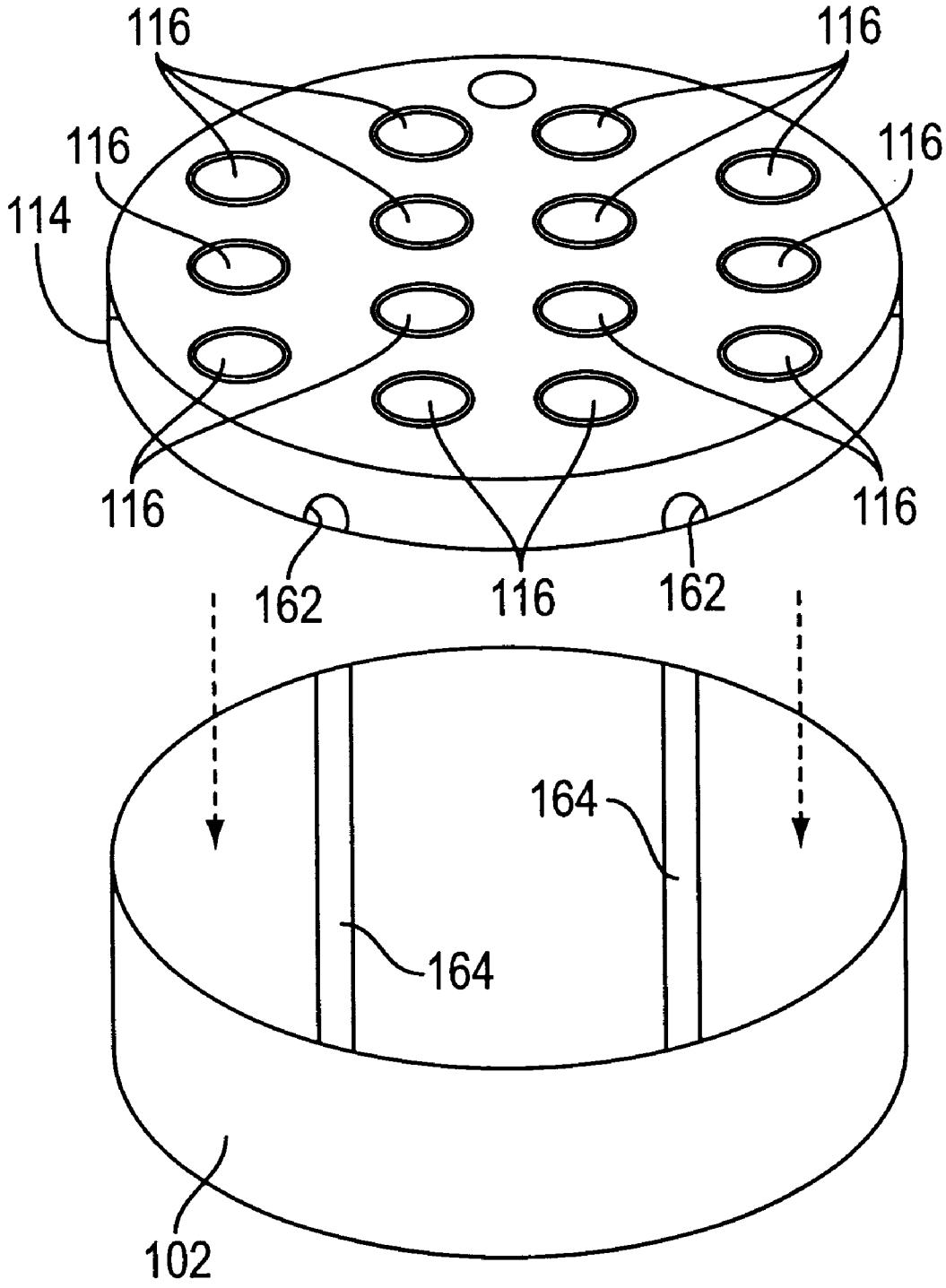
FIG. 8 is a perspective view of the adaptive insert shown in FIGS. 6–7 in alignment with the golf bag according to the present invention.

Yet another important aspect in providing an integrated golf bag and cart which is lightweight, mechanically simple, yet rugged, and capable of being carried in the trunks of most modern cars may be discussed by referenced again to FIGS. 5A, 5B and 6–8. As is shown in FIG. 8, for example, the adaptive insert 114 can include a pair of snap-fit channels 162, each of which is formed to engage a respective one of the pair of walls 164 found in the divider portions 112 of most conventional golf bags. The adaptive insert 114 would, therefore, be pressed in a direction of the dashed arrows shown in FIG. 8 to engage each snap-fit channel 162 with -its respective wall 164. Accordingly, the adaptive insert 114 could be removed from the golf bag 100, if so desired, by pulling up on the adaptive insert 114 through one of the plurality of holes 116 to disengage engage both snap-fit channels 162 from the walls 164.

In any case, the golf bag 100 should also include conventional "kickstand" legs 166 of the type shown in FIG. 4. Such legs 166 may suitably be held in place while the integrated golf bag and cart is pulled by securing them to the sides of the bag 100 through means of Velcro™ strap (not shown). Alternatively, and useful in a kit form of the present invention for bags not having such kickstand legs, a pair of kickstand legs 166' (FIGS. 3 and 4) may be affixed to the side of the bag 100 opposite the handle 126 by way of a sleeve 168. Each of the legs 166' may suitably include a heavy ball 170 to provide for an easy deployment of the legs 166' to support the bag 100 merely by pivoting same about the axis of the transverse bore 110 until gravity pulls the legs 166' outward from the bag 100.

Obviously, many modifications and variations of the integrated golf bag and cart according to the present invention are possible when viewed in light of the foregoing teachings. For example, any golf bag of the type comprising a generally tubular body, open at one end and including a rigid base portion enclosing the other end, could be improved by providing a bore extending transversely through the rigid base portion, and an integrally-formed divider portion adapted to substantially close said one end.

The divider portion would include a plurality of holes which are adapted to receive for storage therein a shaft portion of a golf club in a manner similar to the adaptive insert 114 shown in FIGS. 5A, 5B and 6–8. However, in this configuration, such divider portion would not be removable.

The improved golf bag and cart would also include an axle adapted for insertion through the bore, a pair of wheels, each of which is removably attached to the axle on opposite ends of the bore, and a handle portion removably attached to the golf bag, proximate to the divider portion, for pulling the wheeled golf bag along the ground. It should be understood, therefore, that all such modifications and variations would be deemed to fall within the scope of the appended claims.

What I claim as my invention is:

1. A golf bag, comprising:

a generally tubular body having soft sides, open at one end and including a rigid base portion enclosing the other end, said rigid base portion having a bore extending transversely therethrough;

a divider portion substantially enclosing said one end and including a plurality of holes, each of which is adapted to receive for storage therein a shaft portion of a golf club;

an axle adapted for insertion through said bore;

a pair of wheels, each of which is removably attached to said axle on opposite ends of said bore; and a handle portion removably attached to the golf bag, proximate to said divider portion, for pulling the wheeled golf bag along the ground, wherein said divider portion includes a means for coupling said handle portion to the golf bag, and wherein said coupling means comprises a joint defined by the coupling of a female member formed in said divider portion and adapted to receive a male member formed on said handle portion, and further wherein said joint comprises an internal threaded portion forming said female member and an external threaded portion forming said male member.

2. The golf bag according to claim 1, wherein said divider portion further comprises resilient means for protecting the shaft portions of each golf club received within respective ones of said plurality of holes.

3. The golf bag according to claim 2, wherein said resilient means comprises felt covering the entire periphery of each said hole.

4. The golf bag according to claim 2, wherein said resilient means further comprises a shock absorbing material.

5. In a golf bag comprising a generally tubular body having soft sides, open at one end and including a rigid base portion enclosing the other end, the improvement comprising:

a bore extending transversely through said rigid base portion;

a divider portion adapted to substantially close said one end, said divider portion including a plurality of holes which are adapted to receive for storage therein a shaft portion of a golf club;

an axle adapted for insertion through said bore;

a pair of wheels, each of which is removably attached to said axle on opposite ends of said bore; and a handle portion removably attached to the golf bag, proximate to said divider portion, for pulling the wheeled golf bag along the ground, wherein said divider portion includes a means for coupling said handle portion to the golf bag, and wherein said coupling means comprises a joint defined by the coupling of a female member formed in said divider portion and adapted to receive a male member formed on said handle portion, and further wherein said joint comprises an internal threaded portion forming said female member and an external threaded portion forming said male member.

6. In a golf bag comprising a generally tubular body, open at one end and including a rigid base portion enclosing the other end, the improvement comprising:

a bore extending transversely through said rigid base portion;

a divider portion substantially enclosing said one end;

an adaptive insert, including a plurality of holes which are adapted to receive for storage therein a shaft portion of a golf club, engagably fitted into said divider portion;

an axle adapted for insertion through said bore;

a pair of wheels, each of which is removably attached to said axle on opposite ends of said bore; and a handle portion removably attached to the golf bag, proximate to said adaptive insert, for pulling the wheeled golf bag along the ground, wherein said divider portion includes a means for coupling said handle portion to the golf bag, and wherein said coupling means comprises a joint defined by the coupling of a female member formed in said divider portion and adapted to receive a male member formed on said handle portion, and further wherein said joint comprises an internal threaded portion forming said female member and an external threaded portion forming said male member.

7. The golf bag according to claim 6, wherein said adaptive insert portion further comprises resilient means for protecting the shaft portions of each club received within respective ones of said plurality of holes.

* * * * *